United States Patent [19]

McElfresh et al.

[11] Patent Number: 4,660,231

[45] Date of Patent: Apr. 28, 1987

[54] AUTOMATIC TOILET BOWL CLEANER DISPENSER

[75] Inventors: Mark W. McElfresh, Erlanger, Ky.; Martin E. Bellersen, Cincinnati, Ohio

[73] Assignee: The Drackett Company, Cincinnati, Ohio

[21] Appl. No.: 852,057

[22] Filed: Apr. 15, 1986

[51] Int. Cl.[4] ..... E03D 9/02; E03D 9/03

[52] U.S. Cl. ..... 4/228; 4/222; 4/227; 222/64; 222/67

[58] Field of Search ..... 4/222, 228, 227, 231, 4/224; 222/58, 67, 64

[56] References Cited

U.S. PATENT DOCUMENTS

| | | | |
|---|---|---|---|
| 2,839,763 | 6/1958 | Newsom | 4/227 |
| 2,913,734 | 11/1959 | O'Hare | 4/227 |
| 2,967,310 | 1/1961 | O'Hare | 4/227 |
| 3,698,021 | 10/1963 | Mack et al. | 4/227 |
| 3,774,808 | 11/1973 | La Vange | 4/227 X |
| 3,787,904 | 1/1974 | Lerner | 4/227 |
| 3,841,524 | 10/1974 | Easter | 222/57 |
| 3,908,209 | 9/1975 | Fillmore | 4/228 X |
| 3,965,497 | 6/1976 | Corsette | 4/228 X |
| 4,066,187 | 1/1978 | Nieman et al. | 222/57 |
| 4,294,369 | 10/1981 | Racine | 4/227 X |
| 4,346,483 | 8/1982 | Rosen | 4/227 |

*Primary Examiner*—Henry K. Artis

*Attorney, Agent, or Firm*—Charles J. Zeller

[57] ABSTRACT

This invention relates to a dispenser for discharging a controlled quantity of cleanser into the flush tank of a toilet. The dispenser consists of a container having an open neck, a shroud which fits over the neck and restricts the discharge opening in the neck and a float member slidably connected to the shroud which has means to seal the discharge opening thereby controlling the discharge of the cleanser.

14 Claims, 8 Drawing Figures

Fig. 4.
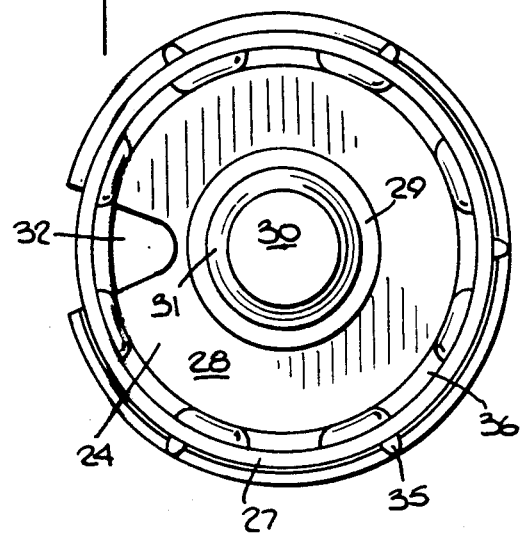
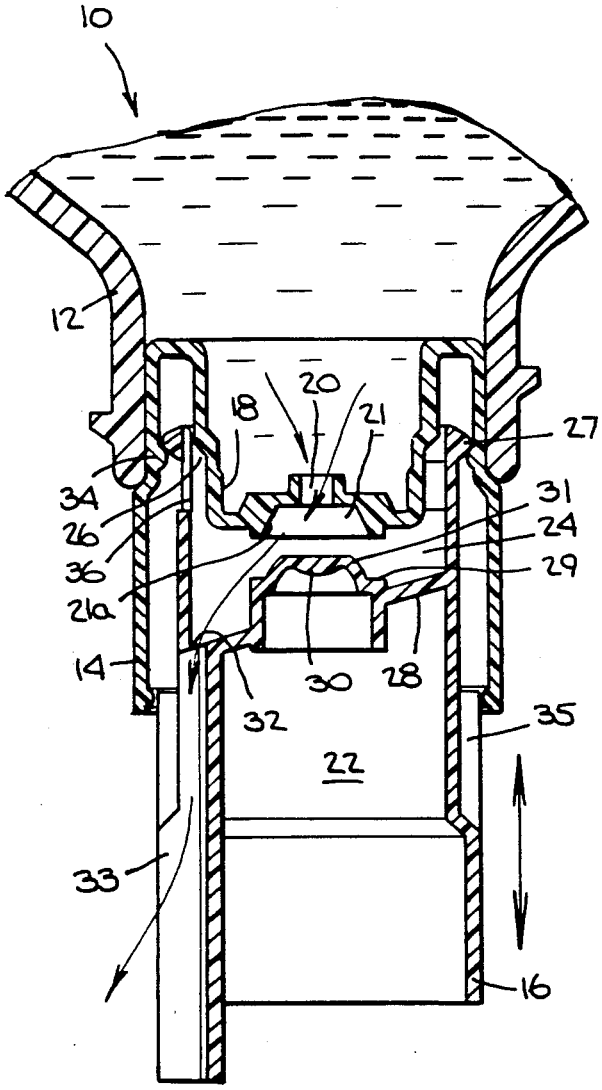
Fig. 3.
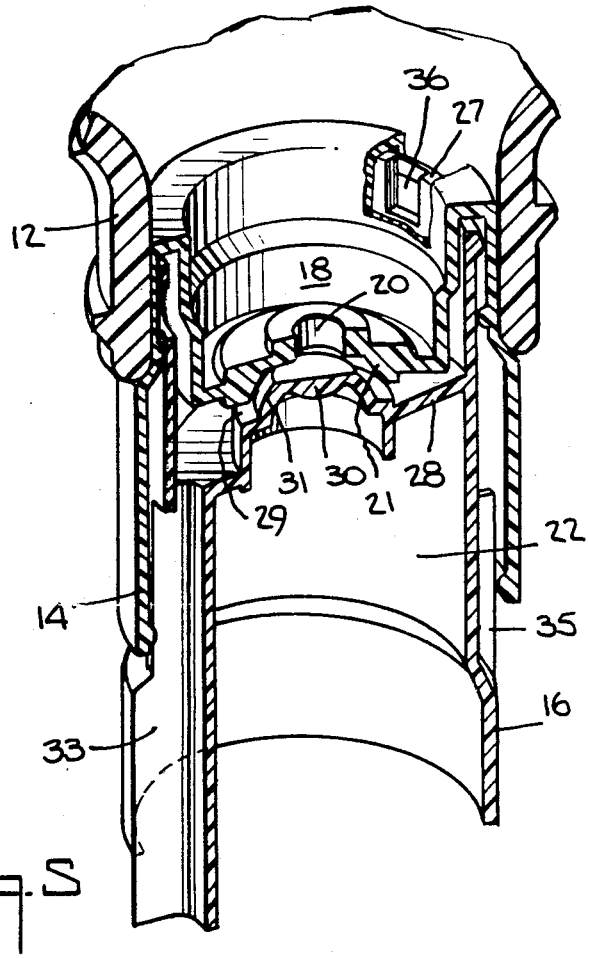
Fig. 5

AUTOMATIC TOILET BOWL CLEANER DISPENSER

BACKGROUND OF THE INVENTION

Many devices are presently available which attempt in various ways to dispense a cleaner into a toilet bowl. These devices have many problems. Generally they dispense inconsistent amounts of cleanser or allow water to leak into the container thereby diluting the cleanser and greatly hindering the products effectiveness. A few packages require substantial adjustments before they may be used as dispensers. Other products which overcome these problems require intricate molding steps under close tolerances. Some units are inoperable unless constructed from rigid materials such as glass or require complicated inserts which prevent complete emptying of the container. The subject invention overcomes the problems and provides a simply manufactured, easily used, accurate and effective toilet bowl cleanser dispenser package.

One of the most common devices for dispensing cleanser into a toilet bowl is the type known as the "upstroke" dispenser; that is, the unit dispenses cleanser into the toilet tank when the tank is in the fill cycle. The cleanser is diluted by the water in the tank and remains there until the toilet is flushed again. Only about 15% of this tank water remains in the bowl after the flush cycle is completed. This dilution by the tank water and the low percentage of cleanser retained in the bowl by the upstroke type dispensers limit the number of formula performance options available.

One such device is that described in U.S. Pat. No. 3,698,021 to Mack et al. wherein a device for dispensing toilet bowl cleanser or disinfectant from a necked container is disclosed. The Mack et al. device has a shroud that fits over the neck of the bottle which shroud has slidably retained therein a float member consisting of a measuring chamber and an air bell. The measuring chamber has a series of outlets formed in the periphery of the upper wall and further has a projection for sealing a restricted discharge opening in the shroud to control fluid flow from the container. In operation the container is inverted in the toilet flush tank in a position which will allow the air bell to contact the water in the tank at the high level point. The bouyant force acting on the air bell maintains the projection of the measuring chamber in sealed relation with the discharge opening. The dispenser is activated by the reduction of the water level in the tank as the toilet is flushed. The float member then falls to its lower position and opens the container discharge opening to allow the measuring chamber to fill with the cleanser. The cleanser will flow until the level in the measuring chamber reaches the neck of the bottle and forms an air lock in the surrounding area within the shroud. As the tank fills to the high water mark, the float member is forced upwards to its original position thereby displacing the fluid in the measuring chamber from the outlets in the upper wall of the float into the tank.

To increase the number of formula performance options available, a dispenser that will deliver cleanser as the tank is emptying which would correspond to the "downstroke" action of the dispenser is preferred. When placed near the flush valve of the toilet tank, a downstroke dispenser will deliver cleanser directly to the portion of the tank water that is most likely to remain in the bowl after the flush cycle is completed. The downstroke dispenser will deliver approximately twice the level of cleanser to the toilet bowl as will current upstroke dispensers. As the cleanser is delivered directly to the bowl, formula dilution and/or degradation in upstroke dispenser delivery is reduced. At a minimum, when the downstroke dispenser is not placed near enough to the flush valve to exit before the flush valve closes, the delivery of the downstroke dispenser becomes the equivilent of the current upstroke dispensers. Accordingly, even in the worst of situations the downstroke dispenser will still work as well as the current upstroke dispensers.

However, downstroke dispensers have not been totally satisfactory to date because (1) there is poor sealing between tank water and the container interior, (2) the amount of air forced into the container varies with the depth of the container in the tank, resulting in inconsistent delivery among various makes and models of tanks, (3) the product clings to the sides of the dispensing mechanism resulting in poor dispensing operation, and (4) the molding tolerances to form the dispensers are too great to be economically feasible.

Accordingly, it is an object of the present invention to provide a novel downstroke dispenser for automatically dispensing a cleanser or disinfectant into a toilet bowl with a minimal loss of cleanser effectiveness.

It is a further object of the present invention to provide a flexible package for a toilet bowl cleanser suitable for the retail market which also acts as a dispenser without adjustment when placed in the proper position.

It is yet a further object of the present invention to provide an easily moldable dispenser package which has a minimum of critical tolerances.

It is still a further object of the present invention to provide an accurate and reliable dispenser for a measured amount of cleanser.

DESCRIPTION OF THE INVENTION

FIG. 3 is a sectional view similar to FIG. 2 with the overcap removed and the dispenser inverted in the dispense position.

FIG. 4 is a top plan view of the float member of the dispenser.

FIG. 5 is a half section perspective view of the dispenser.

Figure 1:
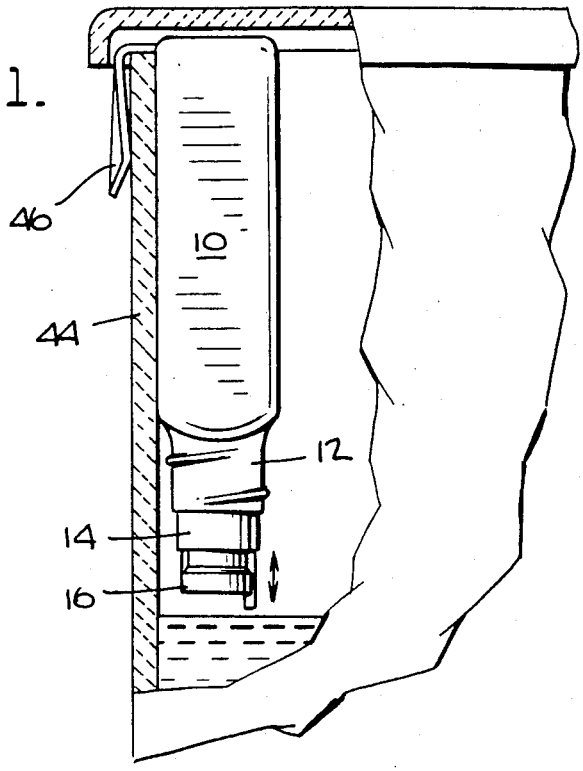
FIG. 1 is a cut-away view of a toilet tank showing the dispenser of the present invention mounted therein.

The preferred embodiment of the present invention comprises a container 10 having an open neck 12, a shroud 14 which may be frictionally retained within or screwed over neck 12 and a float 16 slidably mounted on the inside of shroud 14. In the more detailed description which follows all directions shall refer to the container in its normal operating position, namely inverted.

More specifically, in a preferred embodiment the cylindrical shroud 14 has an interior integrally molded restricting member 18 which is frictionally retained within neck 12. Restricting member 18 has a restricted opening 20 which communicates with the neck opening and restricts its size. Float 16 includes air bell 22 and a chamber 24 which communicates directly with restricted opening 20. Restricted opening 20 has a diameter of about 0.07 to about 0.17 inches and preferably a diameter of about 0.12 inches and a length such that the cleanser surface tension and vacuum within container 10 will be sufficient to retain the balance of the undespensed product without causing unlimited amounts of air to flow back into container 10 upon completion of the discharge cycle. Preferably the length of discharge opening 20 is about 0.02 to about 0.16 inches and most preferably 0.09 inches when the diameter of restricted opening 20 is 0.12 inches.

The amount of cleanser discharged at any one time is believed to be a function of the diameter of restricted opening 20 and the amount of air returned to container 10 as the float member valve body reseats into the shroud valve seat area during the flush tank refill.

Figure 2:
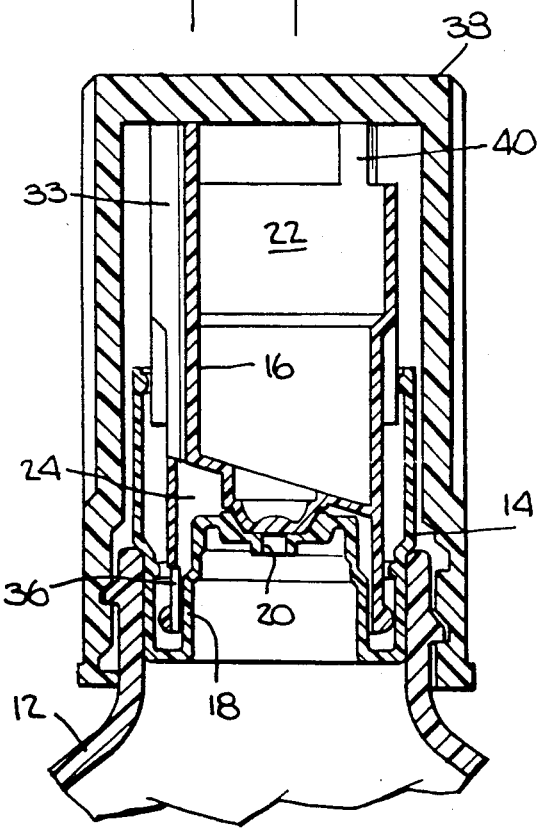
FIG. 2 is a sectional view taken along the axis of the dispenser in the closed position (overcap in place).
Figure 3A:
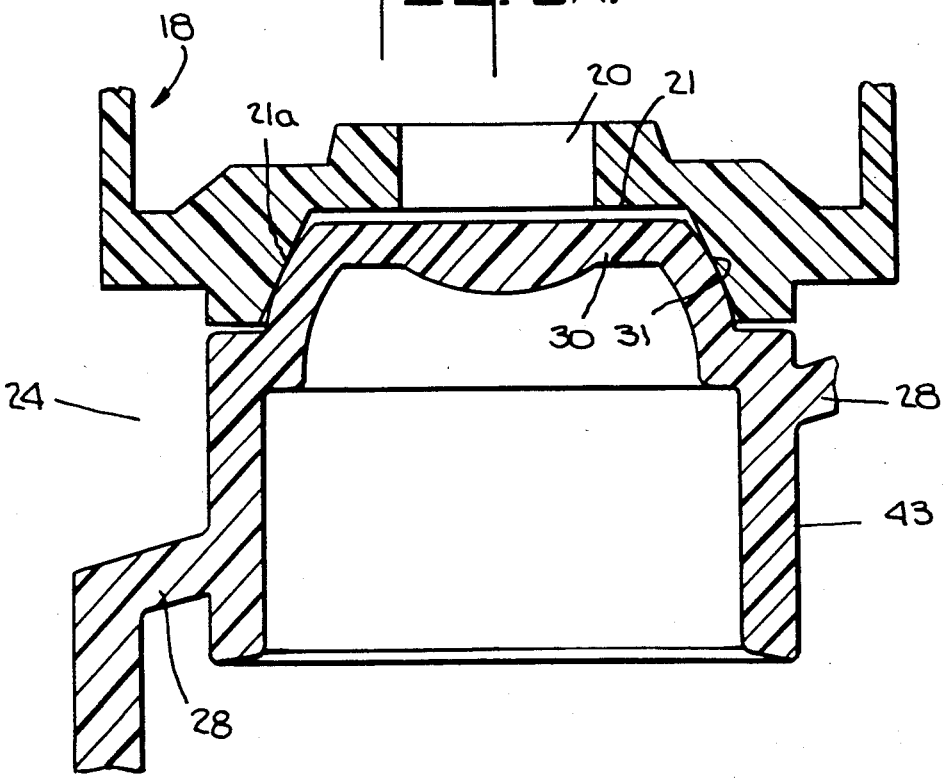
FIG. 3A is an enlarged view of a portion of the embodiment shown in FIG. 3 detailing the sealing means when the tank is filled.

Chamber 24 consists of a small container having an open end 26 for receiving fluid from restricted opening 20 and a bottom floor or dividing wall 28. When float 16 is in its uppermost position as can best be visualized from FIGS. 2 and 3A, chamber 24 surrounds the bottom of restricting member 18. Shoulder 29 of chamber 24 is provided with valve body 30 having sealing surface 31, preferably arcuate in configuration.

The lower end of the restricting member 18 has a valve seat 21 formed therein. Valve seat 21 has a face **21*a* comprising a flat, conical wall which, when float member 16 is in its uppermost position, engages valve body 30 tangentially along a segment of its sealing surface 31 in a sealing relationship. This arrangement permits valve body 30** to provide a more positive seal, permits improved molding tolerances and also reduces the possibility of the float member becoming stuck in the sealed position.

Figure 3B:
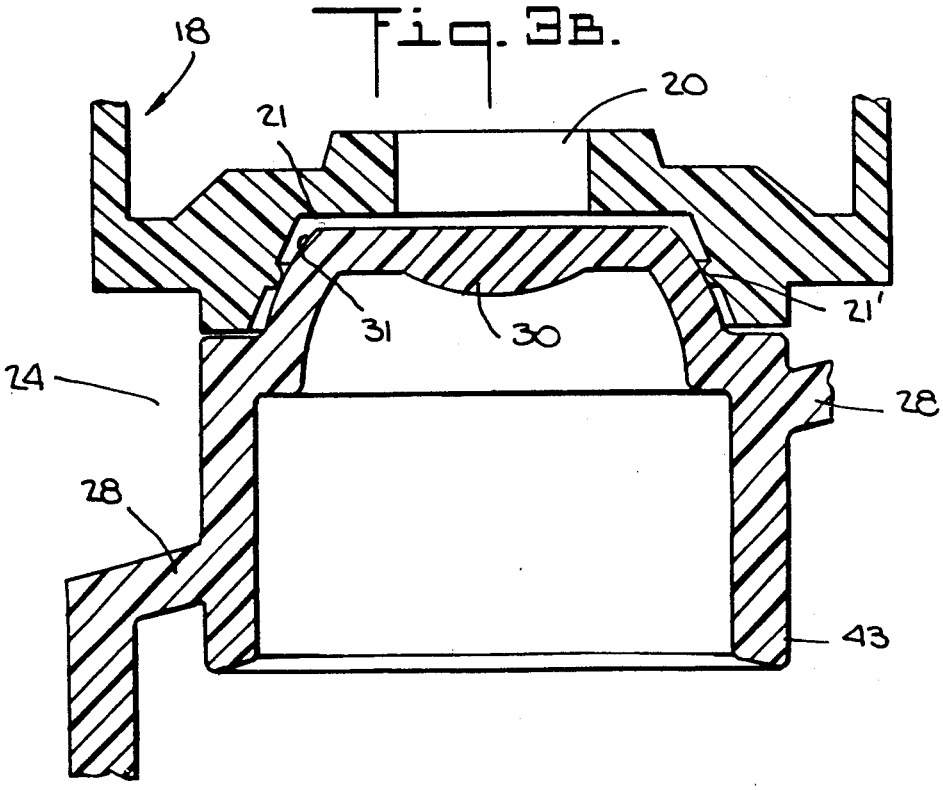
FIG. 3B is an enlarged view of a portion of a further embodiment of the present invention detailing the sealing means when the tank is filled.

In a another preferred embodiment of the present invention, as shown in FIG. 3B, valve seat 21 is provided with an annular bead 21' which provides a more positive seal when valve body 30 is in the uppermost or closed position and its sealing surface 31 is sealably engaged with valve seat 21 at annular bead 21'. Alternatively, the annular bead may be located on sealing surface 31.

Molded integrally with chamber 24 and extending downward therefrom is air bell 22 which comprises an enclosure having an open end at its lower extremity. Chamber floor 28 preferably is inclined at an acute angle to insure drainage even when the consumer incorrectly aligns the dispenser in the tank. Preferably chamber floor 28 is inclined at an angle of 5° to 30° and most preferably 15°.

Chamber floor 28 is provided with discharge opening 32 which communicates with the flush tank through discharge channel 33 molded longitudinally into the sidewall of air bell 22. Discharge channel 33 preferably extends to a point below the lower extremity or edge of air bell 22 thereby preventing the formation of a film of cleanser across the bottom of air bell 22. The formation of such films are undesirable as they prevent uniform dispensing of the total aliquot amount of cleanser on the downstroke cycle.

Chamber 24 is provided with an annular outer retention bead 27 which cooperates with float stop lug 34 to limit the downward travel of float 16. Lug 34 may be either continuous or discontinuous in configuration and is molded into the interior wall of shroud 14. Float 16 also has a plurality of longitudinally extending ribs 35 on its exterior surface which are disposed to bear against the inner wall of shroud 14 to thereby guide it in its vertical movement and restrict its lateral movement within shroud 14. Float 16 is also free to slide from a position where valve body 30 engages valve seat 21 to a position where retention bead 27 engages stop lug 34. Apertures or windows 36 are constructed in the side of chamber 24 to facilitate air return to chamber 24 which allows chamber 24 to fill and empty simultaneously once the water level in the tank falls to such level as to permit float 16 to fall in relationship to shroud 14.

Figure 2A:
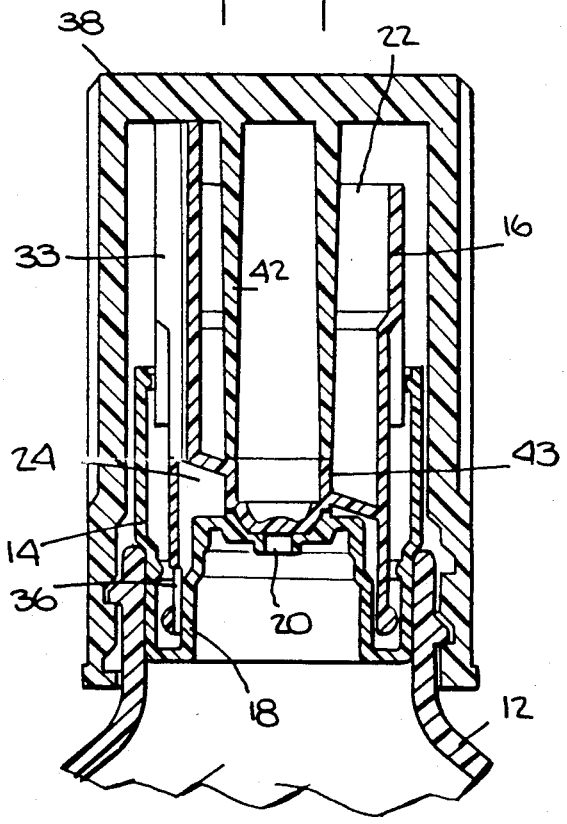
FIG. 2A is a sectional view of another embodiment taken along the axis of the dispenser in the closed position (overcap in place).

As it is desirable to keep the container from leaking until ready for use, the container is provided with an overall cap or closure 38. Retaining projections are also provided to operate in conjunction with closure 38 to seal restricted opening 20. The retaining projections may exist either as projection extensions 40 of the outer extremities of air bell 22 or as a projection 42 of closure 38. When projection 40 forms part of air bell 22, as can be observed in FIG. 2, closure 38 engages projection 40 and maintains float 16 in its sealing position. Alternatively, closure 38 may be provided with a retaining projection 42 and is threaded over the dispenser assembly so that retaining projection 42, as can be observed in FIG. 2A, extends in air bell 22 and engages a cylindrical seating surface 43 projecting outwardly from the under side of chamber floor 28 to maintain float 16 in its sealing position during shipment and storage.

In operation, when container 10 is inverted in the toilet flush tank as shown in FIG. 1, the liquid cleanser in the container is prevented from discharging by the seal formed by valve body 30 seating in valve seat 21 and valve body sealing surface 31 contacting valve seat face **21*a* when float 16 is in its uppermost position with the flush tank filled. Upon flushing of the toilet, the water level recedes allowing float 16 to drop thereby moving valve body 30 away from valve seat 21 and allowing cleanser to flow through restricted opening 20 into chamber 24 until a partial vacuum forms in container 10 which, due to the atmospheric pressure being exerted at restricted opening 20, prevents further flow of cleanser. The cleanser discharged from opening 20 flows into chamber 24 and then into the tank through discharge opening 32 and discharge tube 33. When the tank water rises to fill the toilet tank, float 16 rises within shroud 14 and forces a small amount of air through restricted opening 20 back into container 10 thereby raising the internal pressure within container 10. When float 16 rises to its uppermost position, valve body 30 engages valve seat 21 in a sealing relationship, preventing further discharge of cleanser from container 10**. This process is repeated with every flush and dispenses an accurate amount of cleanser into the toilet tank each time.

An L-shaped mounting bracket 46 is provided at the base of container 10 so that the dispenser may be mounted on wall 44 of the toilet flush tank in the inverted position as shown in FIG. 1. Basically, this bracket comprises an L-shaped member constructed of plastic although it will be obvious that other suitable shapes and materials may be substituted.

In the preferred embodiment, all the components are molded entirely of plastic and with a minimum of precise requirements. The parts are easily molded and assembled. Nevertheless, they function accurately, effectively and dependably.

What is claimed is:

1. In a device for dispensing a measured amount of fluid into a toilet flush tank comprising a liquid container having a body, an open neck portion and closure means; a shroud fastened to and extending from said neck portion and having an inner restricting means defining a restricted opening in said neck portion; a float member slidable and concentrically mounted within said shroud and having upper and lower segments, the upper of which is adjacent to said container neck portion, an air bell constructed in said lower segment of said float member and having an inner and outer wall and a lower extremity having an open end, a chamber constructed in the upper segment of said float member in communication with the restricted opening of said neck portion, said chamber having a discharge opening and projection means for preventing the flow of fluid from said restricted opening of said neck portion at the uppermost position of said float member's sliding motion, and means for mounting said container on the wall of a fluid tank in an inverted position so that said float member rises and falls with the fluid level in the tank, the improvement which comprises a shroud having a lower, inner valve seat located at the lowermost portion of said inner restricting means and in communication with said restricted opening in said neck portion and a float member wherein the chamber of said float member has projection means forming a valve body having the surface of its outer wall adapted to engage the inner wall of said valve seat in a sealing relationship and a floor having a discharge opening located therein, said discharge opening in said floor communicating with a discharge channel extending longitudinally along the outer wall of said air bell and said restricted opening being of such size as to allow a vacuum to form in the container as said measured amount of fluid has been dispensed.

2. The dispensing device of claim 1 wherein the discharge channel extends longitudinally beyond the outer wall of the lower extremity of the air bell.

3. The dispensing device of claim 2 wherein the floor of the chamber is inclined at an angle of about 5° to about 30° and the discharge opening in said floor is located at the lowest point thereof when said device is mounted in an inverted position.

4. The dispensing device of claim 4 wherein the floor of the chamber is inclined at an angle of about 15°.

5. The dispensing device of claim 1 wherein the restricted opening in the shroud has a diameter of about 0.07 to about 0.17 inches when the length of said opening is about 0.02 to about 0.16 inches.

6. The dispensing device of claim 2 wherein the restricted opening in the shroud has a diameter of about 0.12 inches and a length of about 0.09 inches.

7. The dispensing device of claim 3 wherein the restricted opening in the shroud has a diameter of about 0.12 inches and a length of about 0.09 inches.

8. The dispensing device of claim 1 wherein the valve seat has an annular bead formed on its face which is adapted to engage the valve body in a sealing relationship.

9. The dispensing device of claim 1 wherein the valve body has an annular bead formed on its outer face which is adapted to engage the valve seat in a sealing relationship.

10. The dispensing device of claim 1 wherein the closure means is provided with a retaining projection which engages the float member when the closure means is fastened to the container thereby causing the valve body of said chamber to engage the valve seat in a sealing relationship.

11. The dispensing device of claim 1 wherein the air bell is provided with retaining projections at its lower extremities which engage the closure means when said closure means is fastened to the neck of the container thereby causing the valve body of said chamber to engage the valve seat in a sealing relationship.

12. The dispensing device of claim 1, wherein the shroud is mounted concentrically over the open neck portion.

13. The dispensing device of claim 1 wherein the shroud is mounted within the open neck portion.

14. The dispensing device of claim 1 wherein the valve body has an arcuate sealing surface.

* * * * *